US007231970B2

(12) United States Patent
Matusek et al.

(10) Patent No.: US 7,231,970 B2
(45) Date of Patent: Jun. 19, 2007

(54) NON-ROTATIONAL CASING HANGER AND SEAL ASSEMBLY RUNNING TOOL

(75) Inventors: Michael J. Matusek, Houston, TX (US); William A. Abreo, Jr., Houston, TX (US)

(73) Assignee: Cameron International Corporation, Houston, TX (US)

( * ) Notice: Subject to any disclaimer, the term of this patent is extended or adjusted under 35 U.S.C. 154(b) by 293 days.

(21) Appl. No.: 10/629,973

(22) Filed: Jul. 30, 2003

(65) Prior Publication Data

US 2005/0023866 A1 Feb. 3, 2005

(51) Int. Cl.
*E21B 33/03* (2006.01)

(52) U.S. Cl. ..... 166/115; 166/125; 166/208

(58) Field of Classification Search ..... 166/378, 166/381, 382, 387, 208, 123, 125, 181, 75.14, 166/86.1, 87.1, 88.1, 88.3, 332.1, 334.2, 166/115

See application file for complete search history.

(56) References Cited

U.S. PATENT DOCUMENTS 3,468,559 A * 9/1969 Alhstone ..... 285/18
3,543,847 A * 12/1970 Haeber ..... 166/348
3,638,725 A * 2/1972 Ahlstone ..... 166/330
3,827,488 A * 8/1974 Piazza et al. ..... 166/208
3,903,965 A * 9/1975 Ahlstone ..... 166/182
3,924,678 A * 12/1975 Ahlstone ..... 166/120
3,924,679 A * 12/1975 Jansen, Jr. ..... 166/182
4,019,579 A * 4/1977 Thuse ..... 166/123
4,067,062 A * 1/1978 Baugh ..... 166/125
4,067,388 A * 1/1978 Mouret et al. ..... 166/208
4,674,576 A * 6/1987 Goris et al. ..... 166/382
4,712,621 A * 12/1987 Wightman et al. ..... 166/382
4,836,288 A * 6/1989 Wester ..... 166/348
4,903,776 A 2/1990 Nobileau et al. ..... 166/382
4,928,769 A 5/1990 Milberger et al. ..... 166/382
5,110,144 A * 5/1992 Burton et al. ..... 277/328
6,494,257 B2 * 12/2002 Bartlett et al. ..... 166/86.2
6,679,330 B1 * 1/2004 Compton et al. ..... 166/348
6,729,392 B2 * 5/2004 DeBerry et al. ..... 166/75.14
2002/0189813 A1 * 12/2002 Bartlett et al. ..... 166/368
2003/0150620 A1 * 8/2003 DeBerry et al. ..... 166/368
2005/0006106 A1 * 1/2005 Hirth et al. ..... 166/382

OTHER PUBLICATIONS

Cameron STM-15 "S" Subsea Wellhead System Manual, Apr. 1, 1997, index page, pp. 1-18 through 1-25, United States of America.

* cited by examiner

*Primary Examiner*—Hoang Dang
(74) *Attorney, Agent, or Firm*—Peter Bielinski

(57) ABSTRACT

A non-rotational casing hanger and seal assembly running tool for use in oil and gas drilling operations has a mandrel and a tool body that is carried by the mandrel. The tool body supports a plurality of latching segments for releasably connecting the tool body to a seal assembly. A plurality of latching dogs on the tool body releasably connect the tool body to a casing hanger. Axial movement between the tool body and mandrel operates a pressure responsive shuttle piston positioned on the mandrel to urge the seal assembly into sealing position. A ball valve positioned in the mandrel bore is operable between open and closed positions to allow independent operations to be carried out such as cementing the casing hanger in position through the mandrel bore and operating the shuttle piston to then allow overpull to unlatch the tool from the casing hanger for retrieval.

30 Claims, 11 Drawing Sheets

NON-ROTATIONAL CASING HANGER AND SEAL ASSEMBLY RUNNING TOOL

BACKGROUND OF THE INVENTION

1. Field of the Invention

This invention relates to an installation tool for landing a casing hanger in a wellhead and setting a seal assembly in the annulus between the casing hanger and wellhead in a single trip. The installation tool can perform these functions without requiring any rotation of the drill pipe string used for lowering the installation tool, casing hanger and seal assembly into the bore of a subsea wellhead.

The non-rotational casing hanger and seal assembly running tool of the present invention is used in oil and gas drilling operations of the type typically referred to as subsea. These type of oil and gas operations have a wellhead sitting on the ocean floor. As drilling operations proceed, various sizes of casing hangers will be lowered into the wellhead, each casing hanger having a length of casing threaded into to the lower end of the casing hanger. The lengths of casing typically will be from a few hundred feet in length for the larger size casings to several thousand feet of casing for the smaller sizes of casing. The casing hanger itself is a generally tubular member with a beveled outer shoulder sized to land on a mating inner shoulder in the wellhead or a previously installed casing hanger.

After each casing hanger and attached string of casing is landed in the wellhead a cement slurry is pumped through the casing hanger and casing. This cement slurry is forced to the bottom of the casing string where it then flows around the bottom end of the casing string and back up the annulus between the casing string and the drilled hole. After the cement has been placed, a seal assembly or packoff is lowered into the wellhead where it is urged into the annulus between the casing hanger and the inner wall or bore of the wellhead. The seal assembly often requires some mechanism to urge it into its sealed or energized position to ensure a positive seal in the annulus between the casing hanger and the inner wall or bore of the wellhead.

The seal assemblies used in this type of oil and gas drilling operations are typically either an elastomeric seal using the natural elasticity of a rubber compound to seal the annulus or a metal seal using a soft metal compound formed into a plurality of lips that are deformed or energized into contact with the bore of the wellhead and outside diameter of the casing hanger to form the aforementioned annular seal. The metal seals require substantially more force to deform and energize them into their sealing configuration. Previous designs in the industry have either used torque or annulus pressure to energize these metal seals. Those designs utilizing torque have used rotation of the drill string to operate a threaded ring to apply the needed force. These designs have a couple of major limitations: it is difficult to determine how much of the applied torque is being applied to the threaded ring and how much of the torque is being expended in rotation of the long drill pipe string and the drag of the drill pipe string on the wellbore and as wellheads are deployed in ever greater water depths more of the applied torque is lost in the drag of the drill pipe string on the wellbore than is applied to the threaded ring. The previous designs using annulus pressure have been limited by the pressure that can be applied in the annulus between the inner and outer casing strings being sealed. This pressure limitation prevents enough pressure from being generated to generate the substantial force required to energize a metal seal.

Additionally, it is preferable if the tool used to lower the casing hanger and set the seal assembly in the casing hanger—wellhead annulus can accomplish these tasks in one trip. As wells are drilled in ever deeper water depths, the time for lowering a tool to the sea floor and retrieving it increases dramatically and this translates into higher drilling costs as the cost of the rig time required to perform these operations is high. It is therefore desirable to have an installation tool that can lower a casing hanger and associated seal assembly into a well bore, land the casing hanger, allow cementing and energize the seal assembly in a single trip without requiring rotation of the drill string. The non-rotational casing hanger and seal assembly running tool of the present invention offers a substantial improvement by offering a tool that can perform these functions in a single trip and allow testing of the installed seal assembly without requiring rotation of the drill striing.

2. Description of Related Art

U.S. Pat. No. 4,903,776 to P. C. Nobileau et al. shows a casing hanger running tool using drill string tension to set the packoff. The axial movement of the drill string is used in conjunction with differential area pistons to apply force on a sleeve to set the packoff.

A casing hanger running tool using string weight is disclosed in U. S. Pat. No. 4,928,769 to L. J. Milberger et al. This device also uses the weight of the drill string acting on differential area pistons to drive a setting sleeve downward to set the packoff.

SUMMARY OF THE INVENTION

The non-rotational casing hanger and seal assembly running tool of the present invention is designed for use in those subsea applications where non-rotation of the drill string is preferred or a requirement, i.e., primarily deep water applications or those involving reeled pipe installations. The non-rotational casing hanger and seal assembly running tool includes a mandrel having an upper end adapted for connection to a string of drill pipe and a bore therethrough. A tool body is carried by the mandrel and the mandrel and the tool body are axially moveable relative to one another.

The tool body includes a main body, an upper body and a lower body having a lower end adapted for connection to a string of drill pipe. The main body of the tool body supports a plurality of latching segments circumferentially spaced for releasably connecting the tool body to a seal assembly. A plurality of latching dogs are positioned circumferentially on the lower body of the tool body for releasably connecting the tool body to a casing hanger. The axial movement between the tool body and mandrel operates a pressure responsive shuttle piston positioned on the upper body to urge the seal assembly into the annulus between the casing hanger and a wellhead in which the casing hanger is landed.

The mandrel also includes a ball valve positioned in the mandrel bore that is operable between open and closed positions by axial movement of the mandrel relative to the tool body. The opening and closing of the ball valve allows independent operations to be carried out such as cementing the casing hanger in position through the mandrel bore and operating the shuttle piston to unlatch the tool from the casing hanger for retrieval.

A principal object of the present invention is to provide a seal assembly and casing hanger installation tool that can install a seal assembly and a casing hanger without requiring rotation of the drill pipe string used to lower the seal assembly and casing hanger to the subsea wellhead.

Another object of the present invention is to provide a seal assembly and casing hanger installation tool that can install a seal assembly and casing hanger in a single trip.

A final object of the present invention is to provide a seal assembly and casing hanger installation tool that can perform the additional functions of cementing the casing hanger and perform pressure testing of the seal assembly after installation in a single trip.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1A:
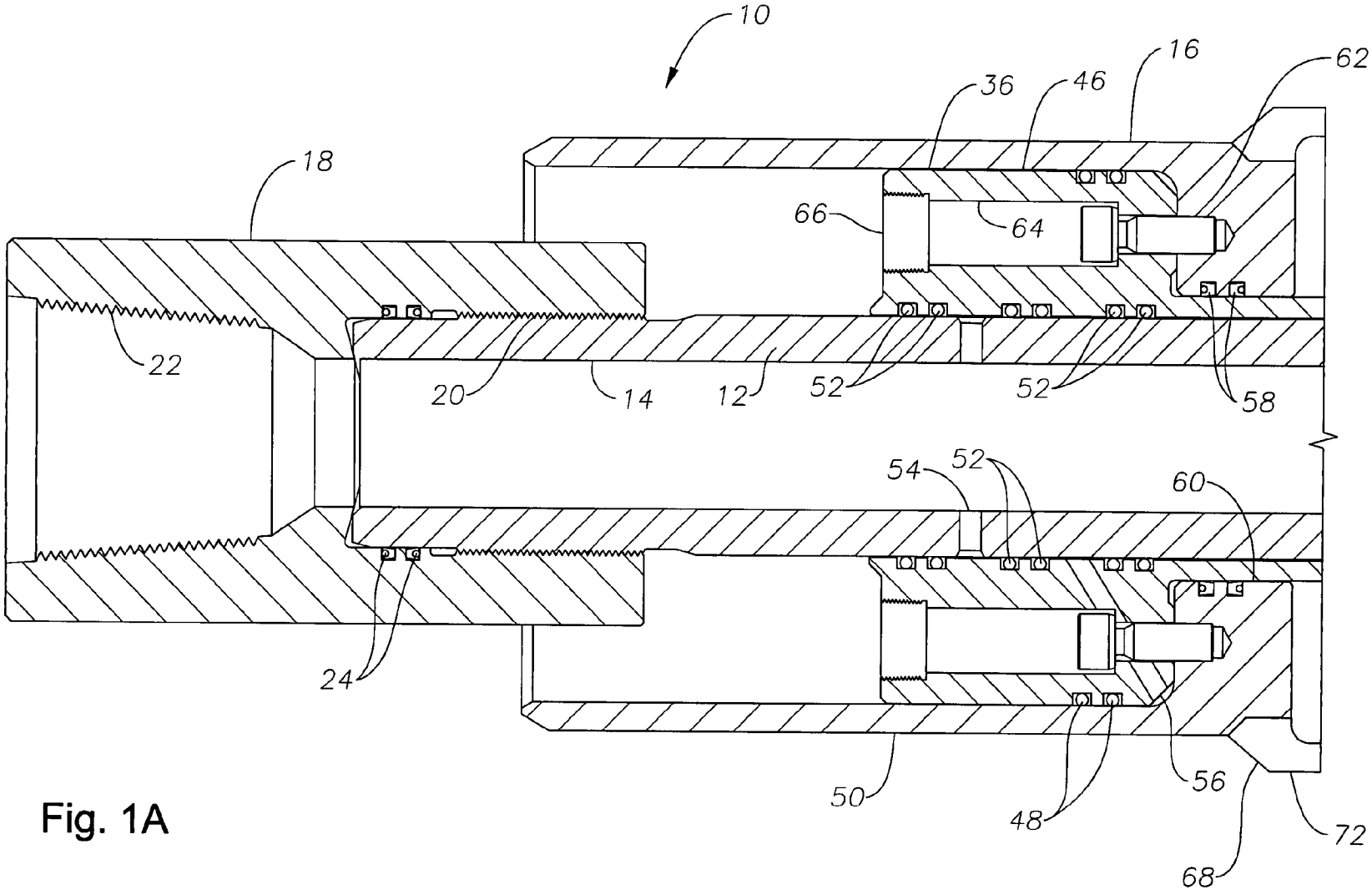
FIGS. 1A, 1B and 1C comprise a full sectional view of the installation tool for landing a casing hanger in a wellhead and setting a seal assembly in the annulus between the casing hanger and wellhead without requiring rotation of the drill pipe string of the present invention with a seal assembly secured on the installation tool and the installation tool lowered into a casing hanger.
Figure 1B:
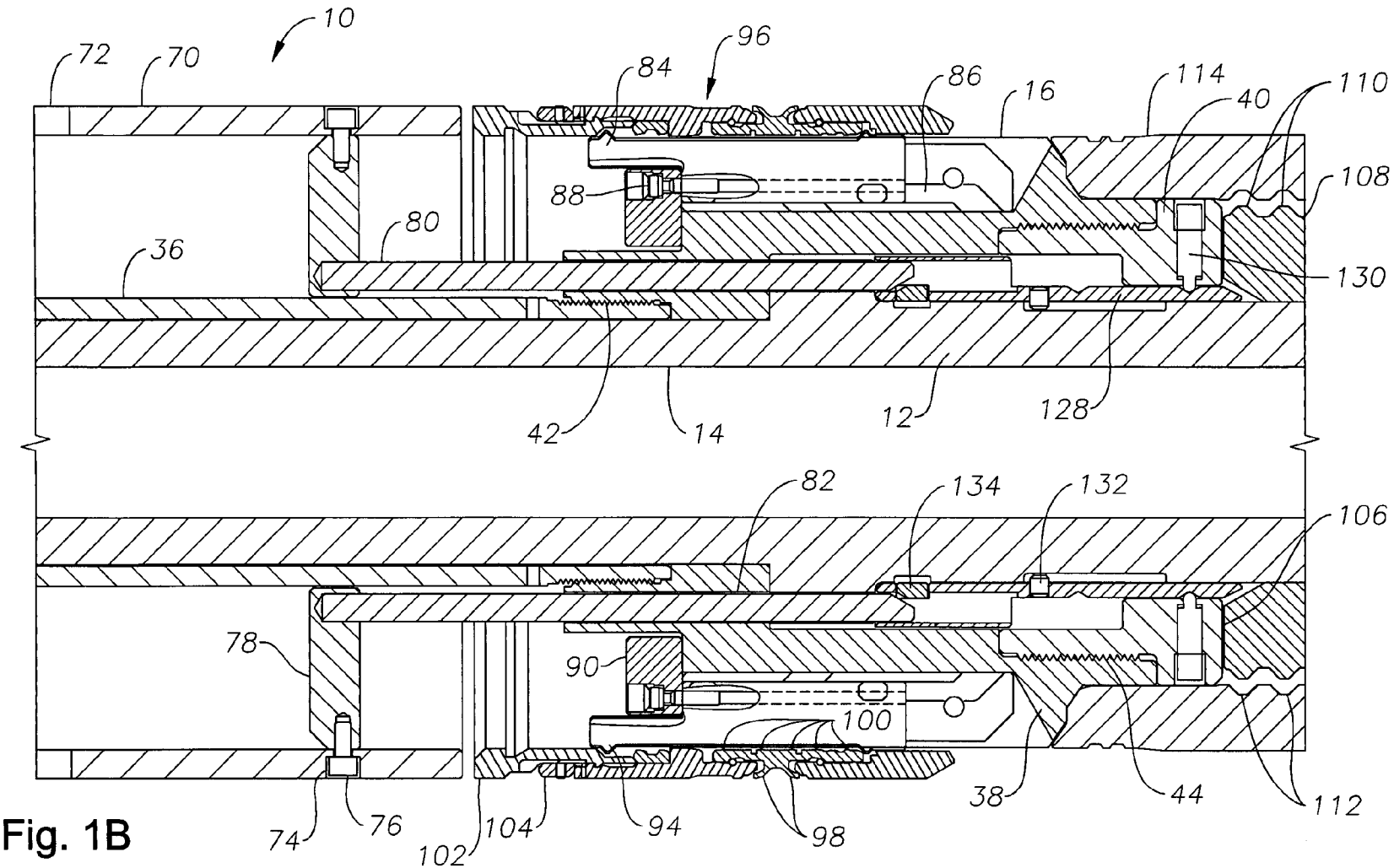
Figure 1C:
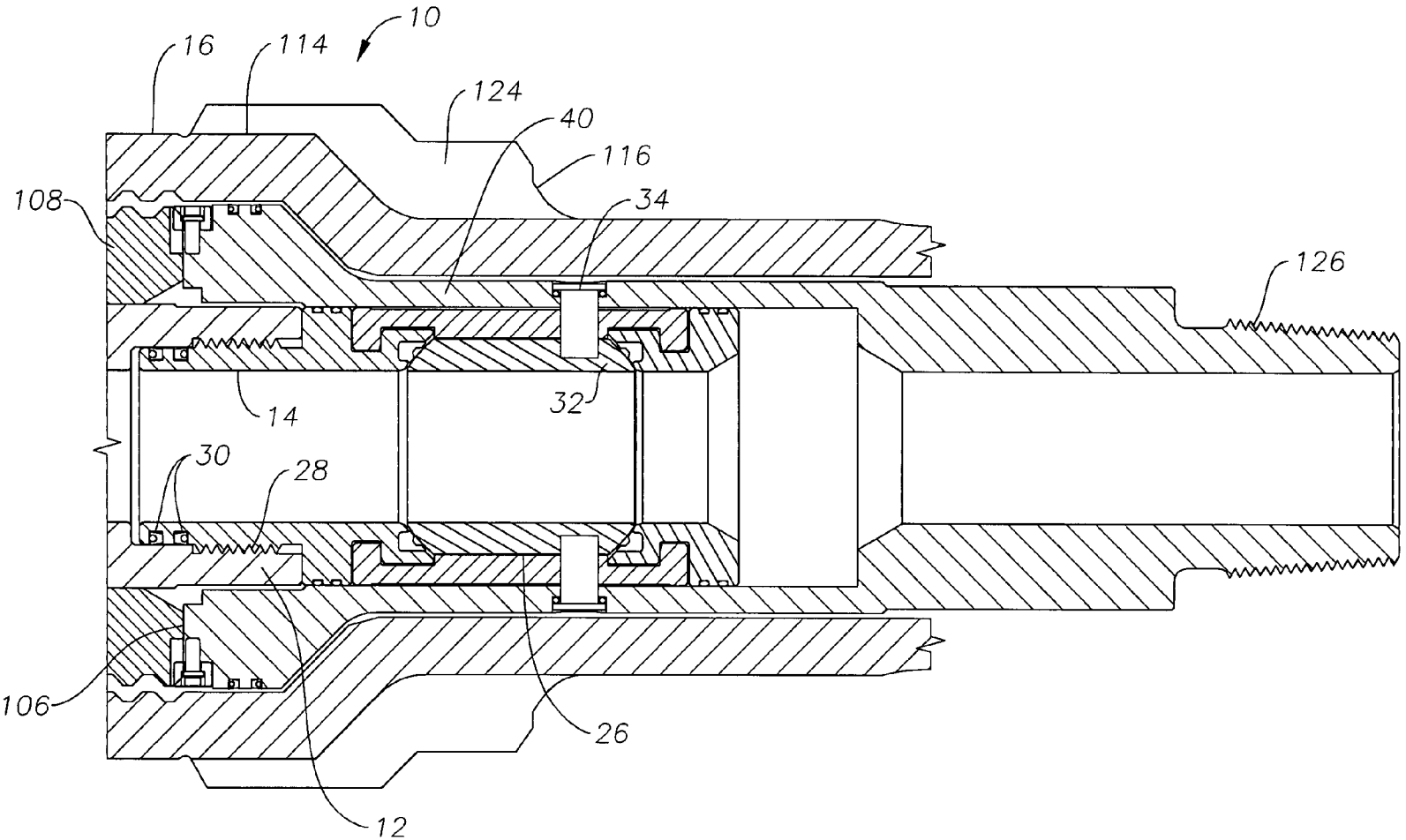

With reference to the drawings, and particularly to FIGS. 1A, 1B and 1C a full sectional view of installation tool 10 for landing a casing hanger in a wellhead and setting a seal assembly in the annulus between the casing hanger and wellhead without requiring rotation of the drill pipe string of the present invention is shown. Installation tool 10 includes mandrel 12 with central bore 14 extending therethrough and tool body 16 carried on mandrel 12 and axially moveable relative to mandrel 12. Mandrel connector 18 is secured to the upper end of mandrel 12 by suitable connection means as threads 20. Mandrel connector 18 has internal drill pipe thread 22 formed at the opposite end for connection to a drill pipe string (not shown) that is used for lowering installation tool 10 to a wellhead positioned on the seafloor. Mandrel connector 18 is sealed to mandrel 12 by lip seals 24 adjacent threads 20.

The lower end of mandrel 12 has selectively operable closure means or ball valve 26 secured thereon by threads 28 and sealed by lip seals 30. Ball valve 26 has flow control member or ball 32 positioned in its central bore that is selectively operable by movement of ball pin 34. Movement of ball pin 34 rotates ball 32 between open and closed positions thereby opening and closing bore 14 of mandrel 12. Movement of ball pin 34 is controlled by the relative movement between mandrel 12 and tool body 16 in a manner to be described hereinafter.

Tool body 16 is composed of upper body 36, main body 38 and lower body 40. Upper body 36 is secured to the upper end of main body 38 by threads 42 and lower body 40 is secured to the upper end of main body 38 by threads 44. Upper body 36 forms piston 46 at its upper end with exterior seals 48 sealing on the interior of shuttle piston 50. Three sets of interior seals 52 are spaced axially along the interior of piston 46. The position of interior seals 52 relative to lateral port 54 in mandrel 12 controls the flow of pressurized drilling fluid from lateral port 54 to piston port 56 and thereby the movement of shuttle piston 50. The movement of mandrel 12 relative to upper body 36 opens and closes this passage. Lip seals 58 on the interior of annular shoulder 60 of shuttle piston 50 allow cycling of shuttle piston 50. In the initial running position shown in FIG. 1, shuttle piston 50 is prevented from movement relative to upper body 36 by frangible connection means as tensile bolts 62, circumferentially spaced around upper body 36 in counterbore holes 64. Counterbore holes 64 are plugged with pipe plugs 66 to ensure the pressure integrity of piston 46.

Shuttle piston 50 is a generally cylindrical member with stepped outer shoulder 68 adjacent to interior annular shoulder 60. Lower skirt 70 extends axially downward from stepped outer shoulder 68. A plurality of flow ports 72 are circumferentially spaced around lower skirt 70 and allow drilling fluid to flow between the interior and exterior of shuttle piston 50. A plurality of laterally disposed and circumferentially spaced counterbore holes 74 are formed adjacent the lower end of lower skirt 70. Frangible connection means as shear bolts 76 are positioned in holes 74 and threaded into mating holes in actuator rod head 78. Actuator rod head 78 is an annularly shaped flange with a plurality of actuator rods 80 secured at its inner edge and circumferentially spaced. Actuator rods 80 extend axially from lower skirt 70.

Main body 38 of tool body 16 is secured to upper body 36 by threads 42 as noted above. Main body 38 is a generally cylindrically shaped member surrounding mandrel 12. Actuator rod holes 82 are formed at the upper end of main body 38 and aligned with actuator rods 80 when installation tool 10 is assembled. Positioned on the exterior of main body 38 are a plurality of connection means as latching segments 84 that are axially moveable in tracks 86 formed on the exterior of main body 38. Latching segments 84 are initially held in the up position of FIG. 1 by frangible tensile bolts 88 extending through retainer flange 90. Retainer flange 90 is fastened to main body 38 by bolts 92, shown in FIG. 2B, that are circumferentially spaced from tensile bolts 88. In the up, i.e., initial running position of FIG. 1, latching segments 84 extend radially outward sufficiently to allow retainer lip 94 to engage the interior of seal assembly 96 and hold seal assembly 96 in place.

Seal assembly 96 is designed to effect a metal to metal seal in the annulus between the casing hanger and wellhead. Seal assembly 96 includes outer seal lips 98 and inner seal surfaces 100 that are urged into sealing engagement with the wellhead and casing hanger. Actuator ring 102 urges seal assembly 96 into its sealing position when acted upon by lower skirt 70 of shuttle piston 50. Lock ring 104 engages a complementary groove in the wellhead to lock seal assembly 96 in place.

Lower body 40 of tool body 16 is secured to main body 38 by threads 44 as noted above. Lower body 40 is a generally cylindrically shaped member surrounding mandrel 12. Apertures or windows 106 are formed at the upper end of lower body 40 and evenly spaced around the circumference of lower body 40. Dogs 108 are disposed in windows 106 and include multiple shoulders 110 formed on their outer periphery. Dogs 108 are radially moveable and multiple shoulders 110 engage mating shoulders 112 in casing hanger 114 when installation tool 10 is landed in casing hanger 114. Casing hanger 114 is of the mandrel or shouldered type, with frustoconical outer shoulder 116 designed to land on mating shoulder 118 of previous casing hanger 120 which is landed in wellhead 122 (See FIG. 3B). Frustoconical outer shoulder 116 has mud slots 124 formed in its outer periphery and evenly spaced circumferentially to allow drilling fluid to be circulated past casing hanger 114. The lower end of lower body 40 has drill pipe thread 126 formed thereon for connection to cementing equipment, well known to those of ordinary skill in the art.

Radial movement of dogs 108 is controlled by cam ring 128 positioned on mandrel 12. Cam ring 128 is initially retained by spring plunger 130, radially disposed in lower body 40. Cam ring 128 is aligned with actuator rods 80 through lower body 40 by alignment pin 132. Retrieval ring 134 is positioned near the upper end of cam ring 128 to ensure cam ring 128 is held in position during retrieval of installation tool 10.

Figure 2A:
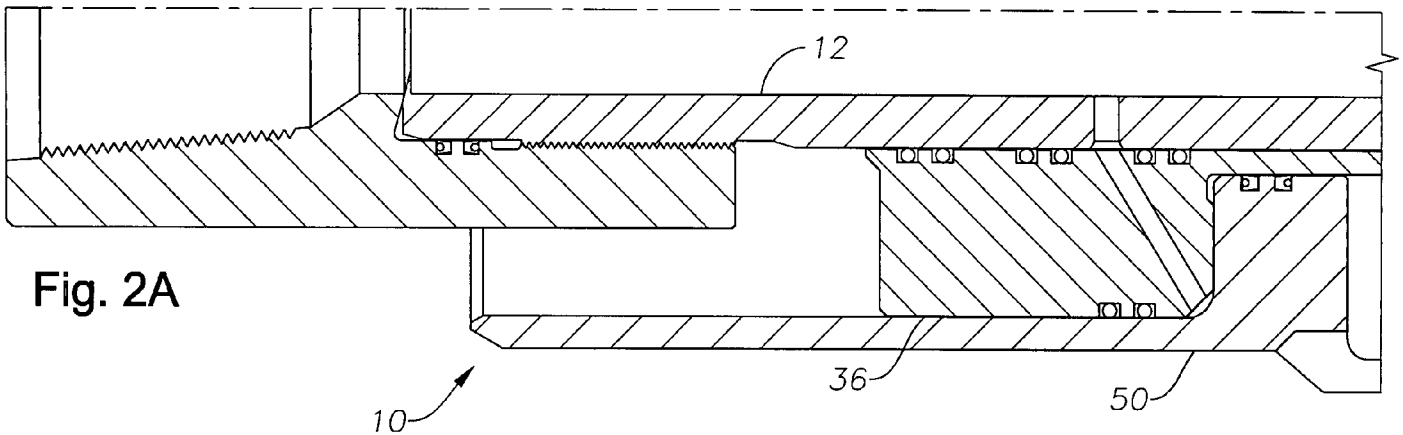
FIGS. 2A, 2B and 2C comprise a half sectional view of the installation tool secured to the casing hanger by the latching dogs.
Figure 2B:
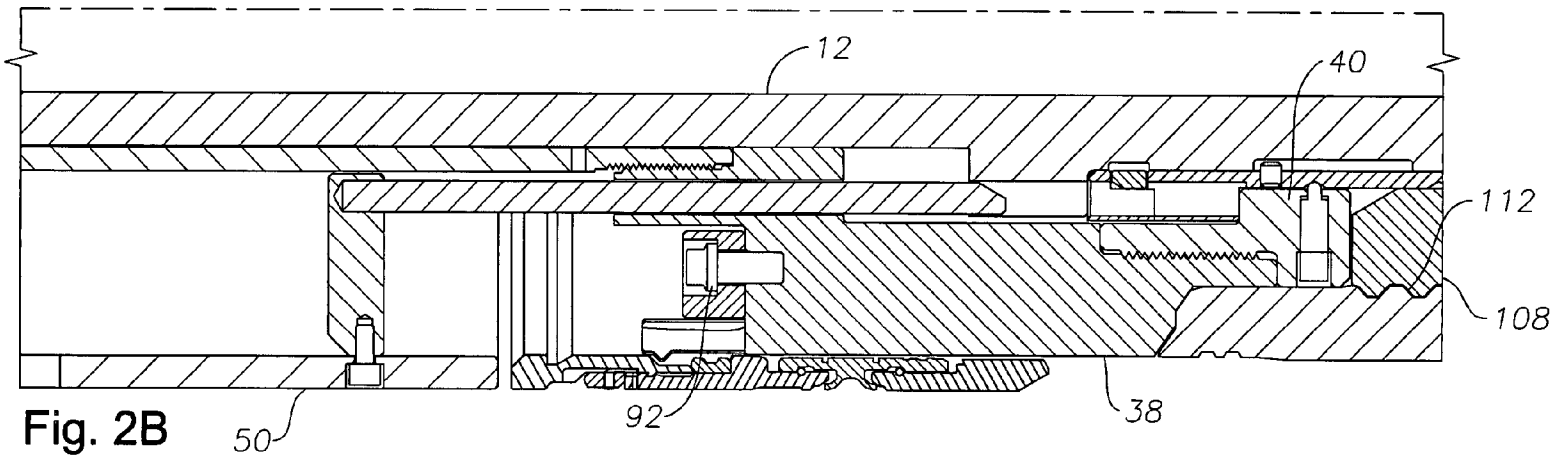
Figure 2C:
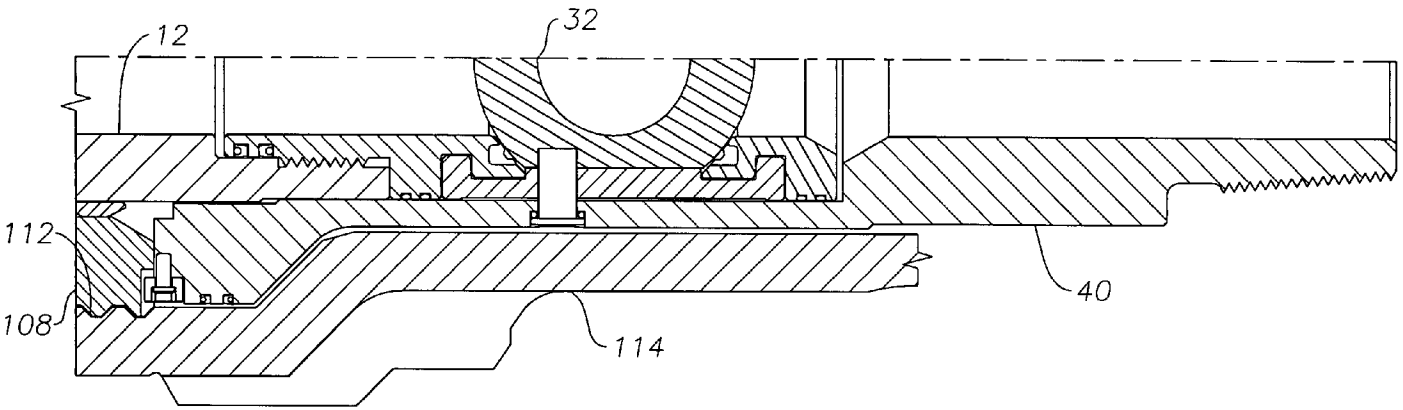

The initial assembly of installation tool 10, seal assembly 96 and casing hanger 114 is shown in FIGS. 1 and 2. Seal assembly 96 is secured to the exterior of main body 38 as noted above and installation tool 10 is set in casing hanger 114 with dogs 108 retracted (FIG. 1). Weight is set on mandrel 12 that overrides the detenting of spring plunger 130 and moves axially allowing cam ring 128 to urge dogs 108 radially outwardly and engage mating shoulders 112 in casing hanger 114 (FIG. 2). Shuttle piston 50 is in its upward position and ball valve 32 is open. At this point, installation tool 10, seal assembly 96 and casing hanger 114 are lowered into wellhead 122.

Figure 3A:
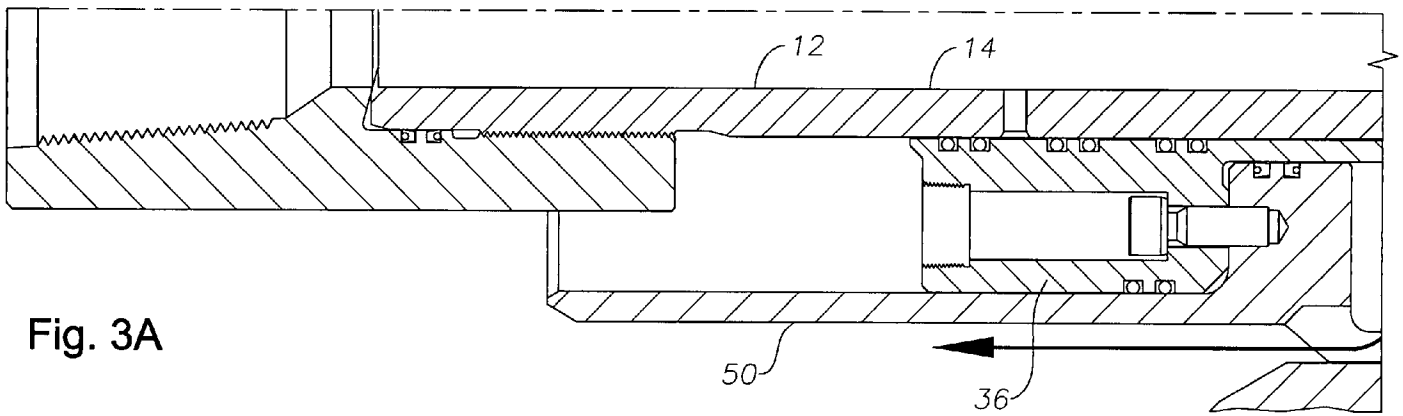
FIGS. 3A, 3B and 3C comprise a half sectional view of the installation tool during well bore cementing operations.
Figure 3B:
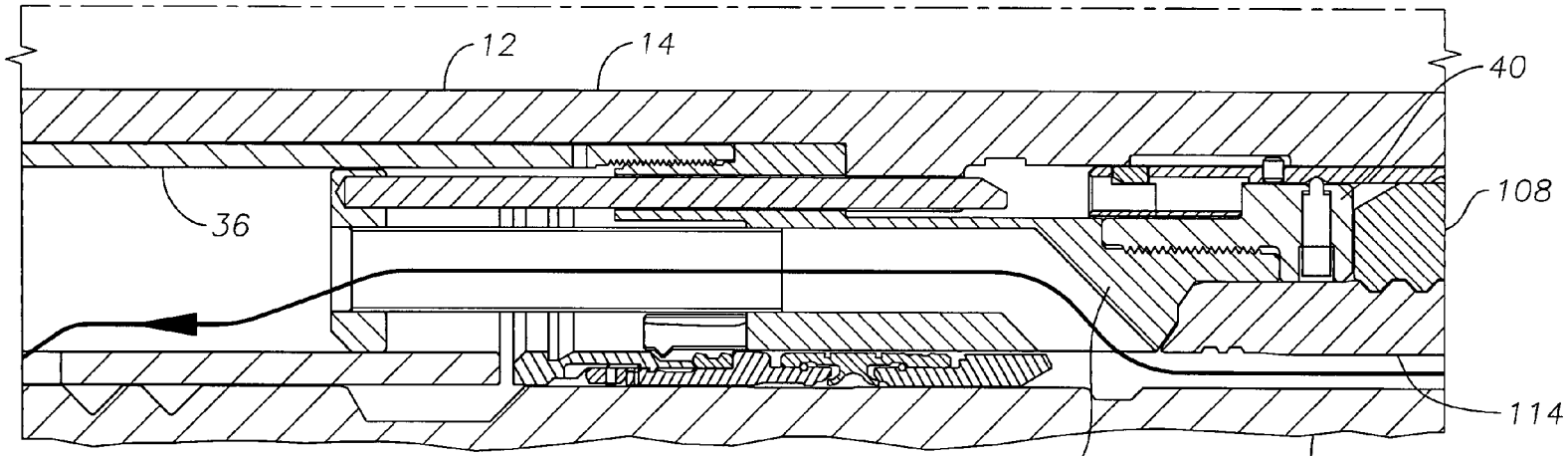
Figure 3C:
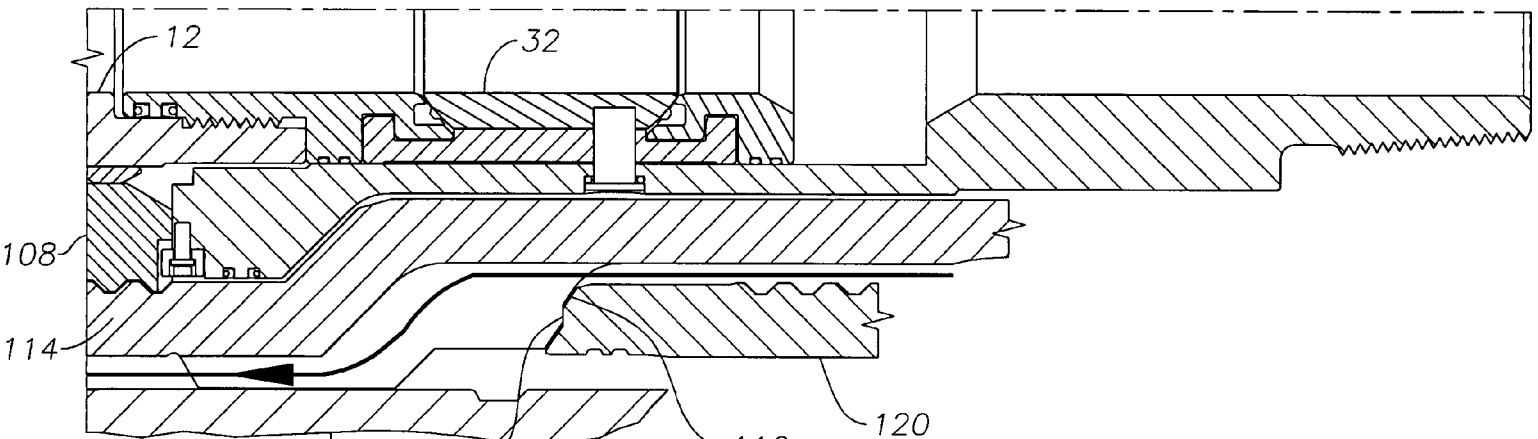

As best seen in FIG. 3, installation tool 10, seal assembly 96 and casing hanger 114 are landed in wellhead 122 with frustoconical outer shoulder 116 of casing hanger 114 setting on mating shoulder 118 of previous casing hanger 120. Although shown with casing hanger 114 sitting on previous casing hanger 120, it will be understood by those of ordinary skill in the art that casing hanger 114 could be landed on a mating shoulder (not shown) in wellhead 122, if appropriately sized, without departing from the scope of the present invention. Ball 32 is open and normal cementing operations are carried out to cement casing (not shown) suspended from casing hanger 114 through central bore 14 of mandrel 12.

Figure 4A:
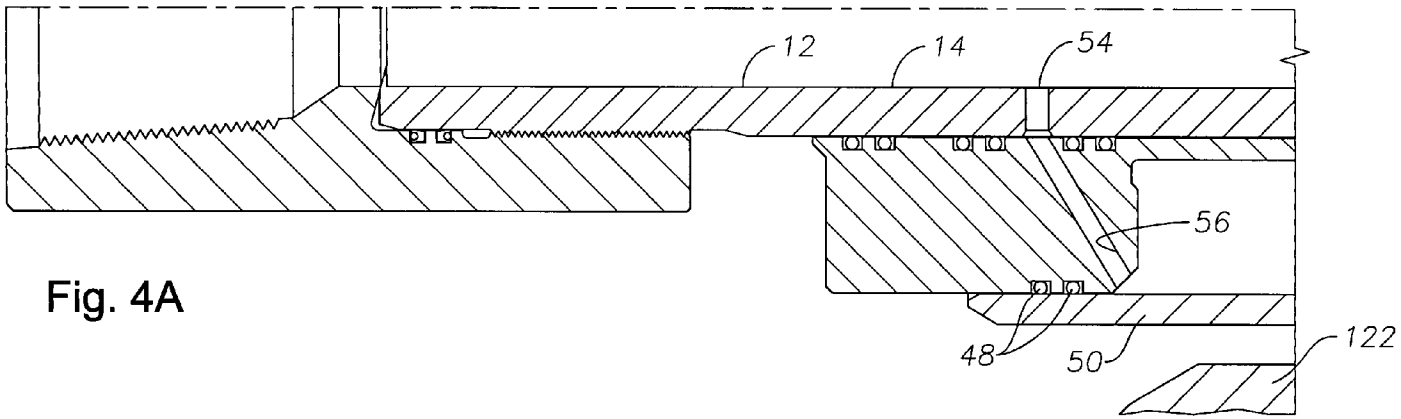
FIGS. 4A, 4B and 4C comprise a half sectional view of the installation tool as the seal assembly is urged into the annulus between the casing hanger and a wellhead housing.
Figure 4B:
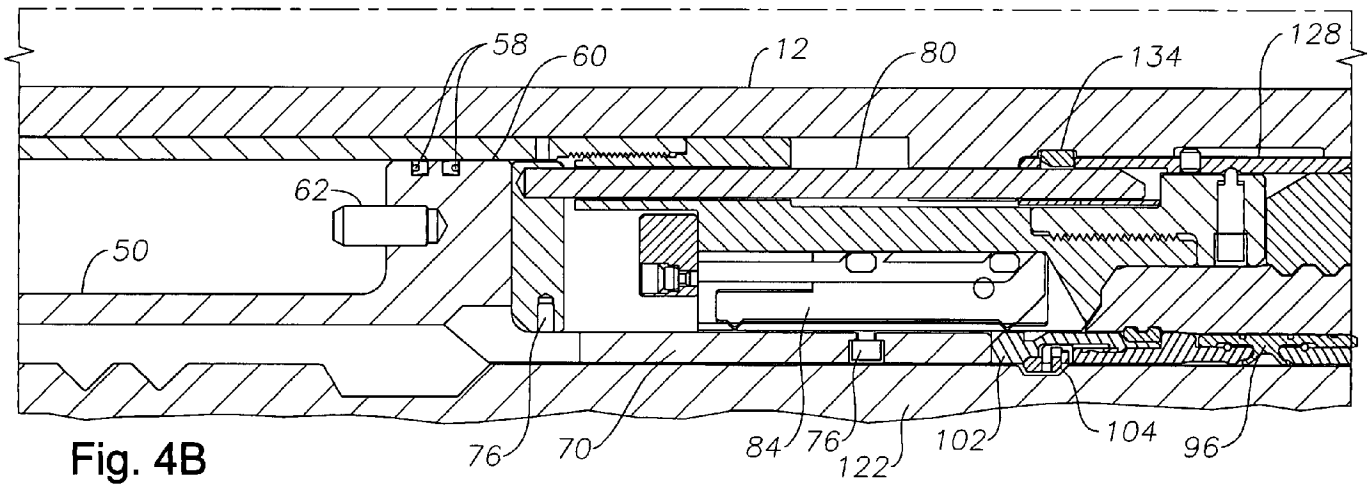
Figure 4C:
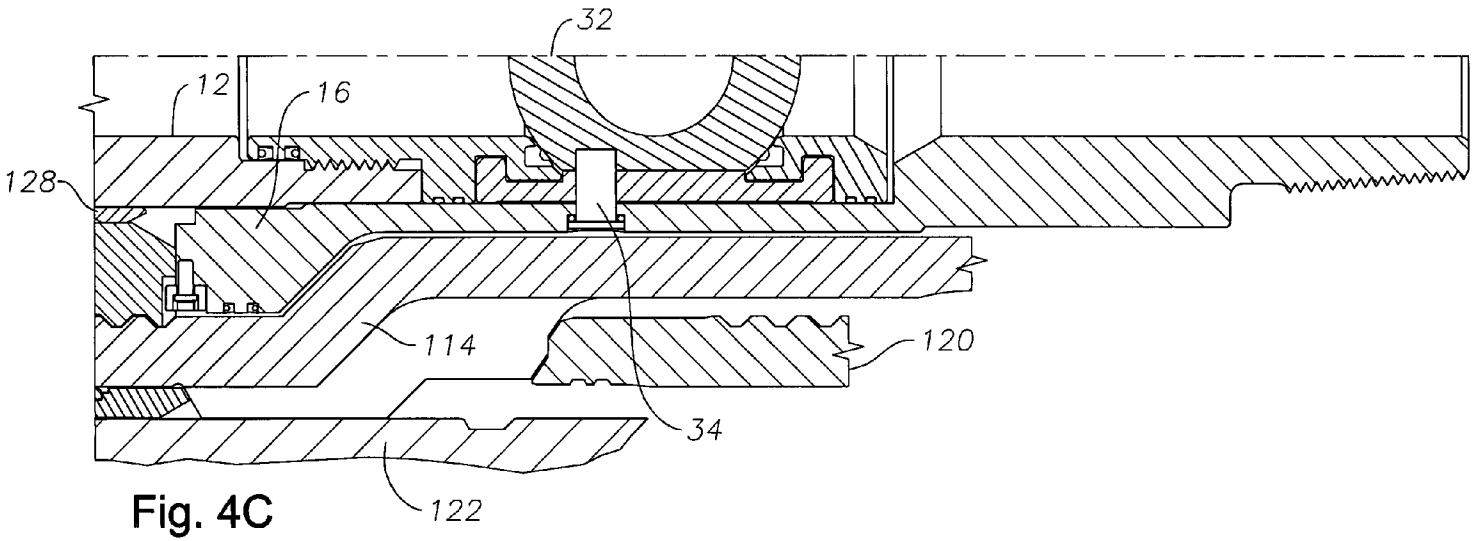

Referring to FIG. 4, with cementing operations completed, weight is set on mandrel 12 to allow mandrel 12 to move axially relative to tool body 16. This causes ball pin 34 to close ball 32. Pressure is then applied through the drill string to bore 14 of mandrel 12. The axial movement of mandrel 12 causes lateral port 54 to align with piston port 56. Pressure applied in bore 14 acts through ports 54 and 56 and on top of annular shoulder 60 between exterior seals 48 and lip seals 58. This force breaks tensile bolts 62 and shuttle piston 50 can move axially. This axial movement of shuttle piston 50 allows lower skirt 70 to act on seal assembly 96 and actuator ring 102 and urge seal assembly 96 into its sealing position. Actuator ring 102 also moves lock ring 104 into a mating groove in wellhead 122 and locks seal assembly 96 in position. As seal assembly 96 is moved into position, latching segments 84 release seal assembly 96, and latching segments 84 move radially inwardly. Also, as shuttle piston 50 moves axially, shear bolts 76 are sheared and actuator rods 80 contacts cam ring 128 and retrieval ring 134 to lock them to mandrel 12.

Figure 5A:
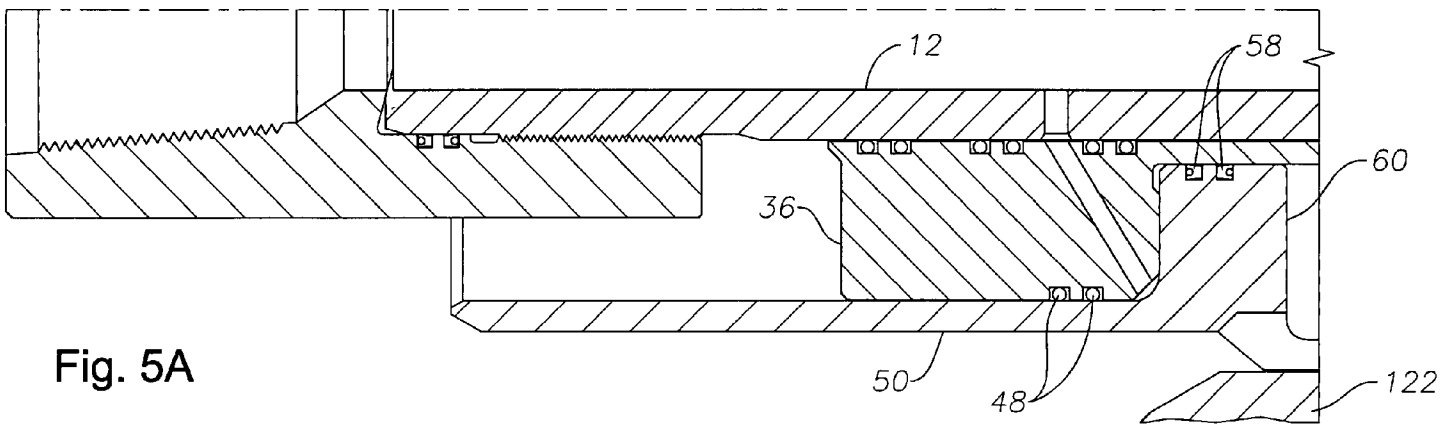
FIGS. 5A, 5B and 5C comprise a half sectional view of the installation tool as the seal assembly is tested.
Figure 5B:
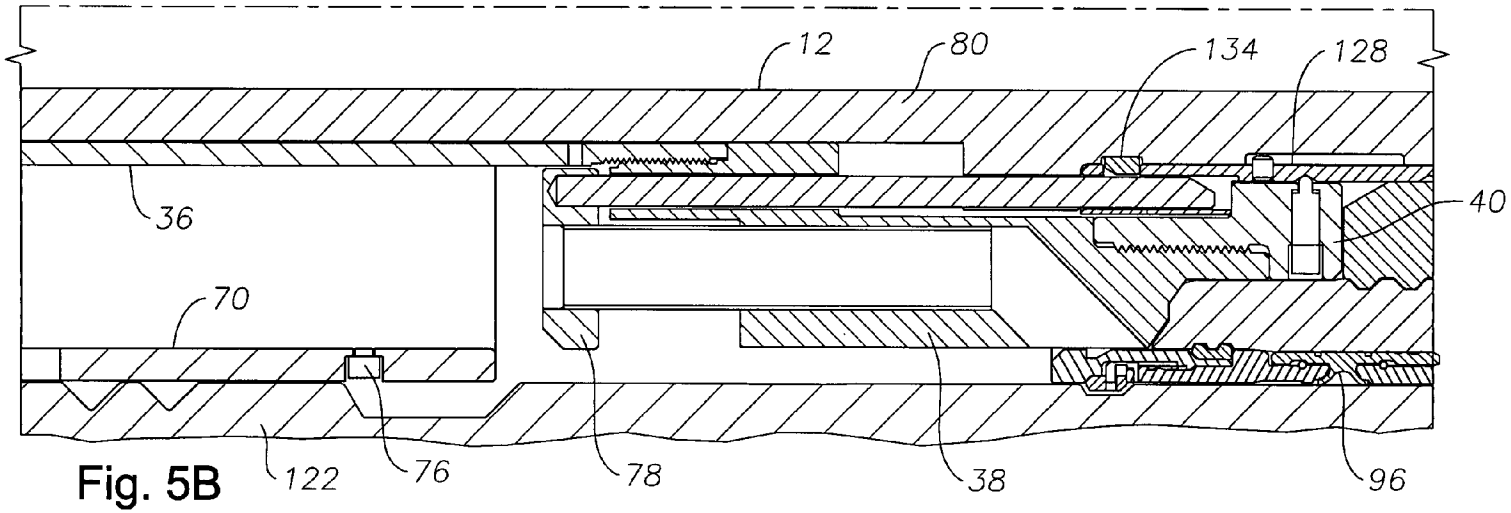
Figure 5C:
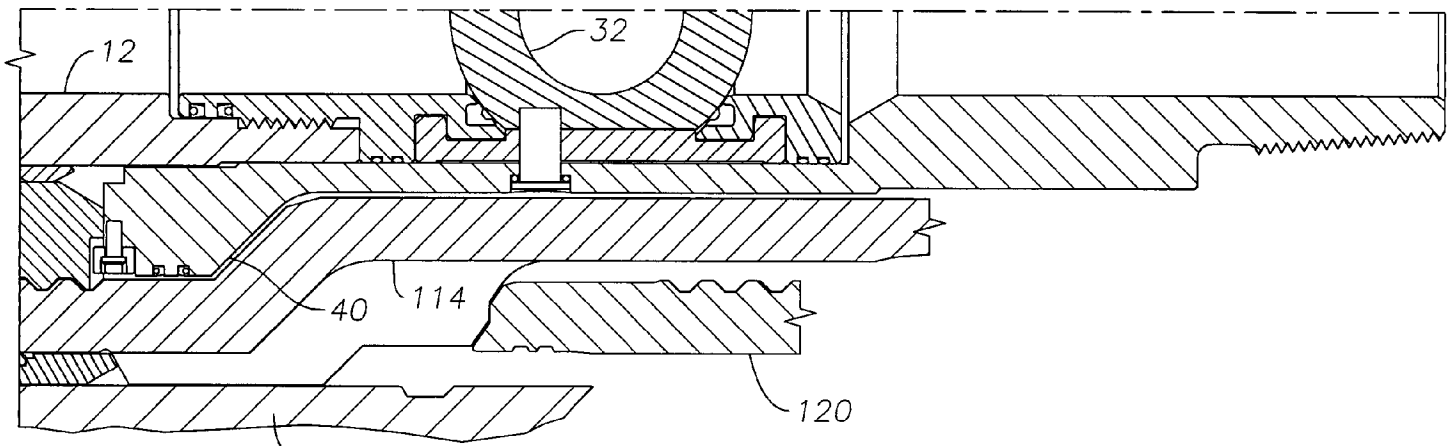

Referring to FIG. 5, pressure testing of seal assembly 96 is accomplished by applying pressure in the kill and choke lines (not shown) to apply pressure in the annulus between casing hanger 114 and wellhead 122 and on top of seal assembly 96. This pressure also serves to cycle shuttle piston 50 back to its initial (up) position. This is due to the force acting on the lower side of annular shoulder 60 between seals 48 and 58. Since shear bolts 76 are broken, actuator rod head 78 and actuator rods 80 are left in the lower position locking cam ring 128 and retrieval ring 134 to mandrel 12.

Figure 6A:
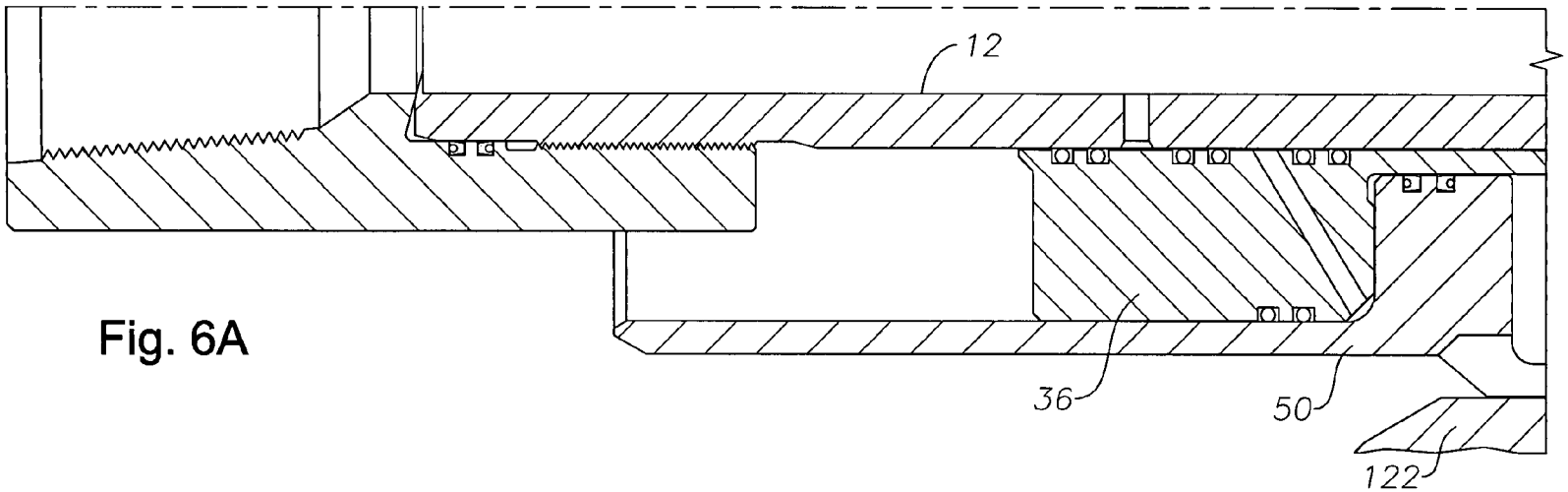
FIGS. 6A, 6B and 6C comprise a half sectional view of the installation tool as disengaged from the casing hanger, prior to retrieval to the surface.
Figure 6B:
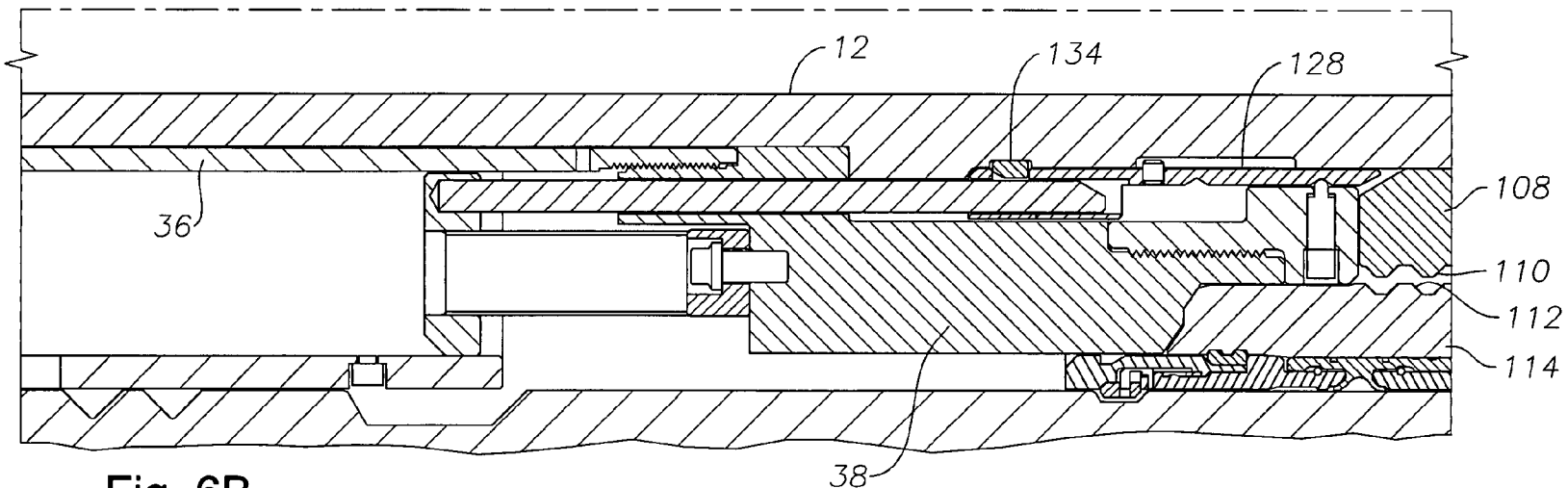
Figure 6C:
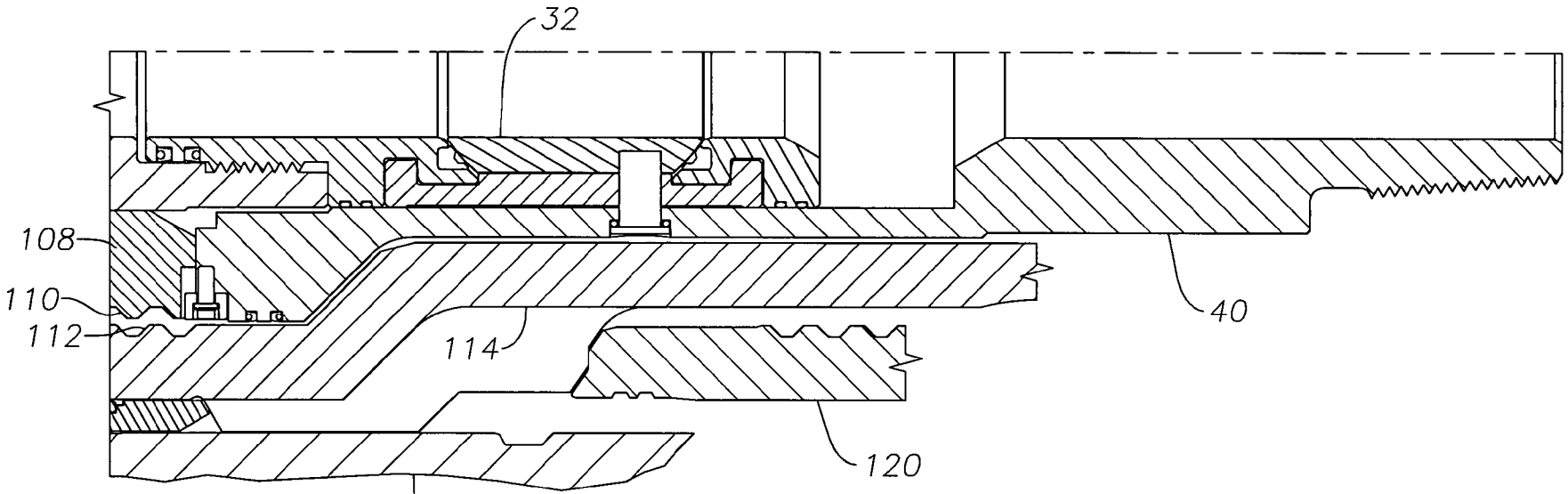

As best seen in FIG. 6, once pressure testing is completed and it is desired to retrieve installation tool 10, tension is applied to mandrel 12. This tension on mandrel 12 and axial movement of mandrel 12 causes cam ring 128 and retrieval ring 134 to move with mandrel 12, thereby releasing cam ring 128 from behind dogs 108. Continued tension on mandrel 12, causes shoulders 110 on dogs 108 to cam against shoulders 112 on casing hanger 114 and urge dogs 108 radially inwardly in windows 106. Installation tool 10 can then be retrieved to the surface.

The construction of our seal assembly and casing hanger installation tool will be readily understood from the foregoing description and it will be seen that we have provided a seal assembly and casing hanger installation tool that can install a seal assembly and a casing hanger without requiring rotation of the drill pipe string used to lower the seal assembly and casing hanger to the subsea wellhead. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. An installation tool for landing a hanger, supported by a tubular string, and setting a seal assembly in the annulus between the hanger and a surrounding tubular, comprising:

a mandrel having an upper end connection to connect to the tubular string and a bore therethrough;

a tool body having a lower end adapted for connection to the hanger, said tool body carried by said mandrel, said mandrel and said tool body axially moveable relative to one another;

at least one first connector positioned on said tool body for releasably connecting said tool body to the hanger without rotation of said upper end connection;

at least one second connector positioned on said tool body for releasably connecting said tool body to the seal assembly;

a pressure responsive shuttle piston on said mandrel, said shuttle piston is axially moveable to urge the seal assembly into the annulus between the hanger and the surrounding tubular in which said hanger is landed, without rotation of said upper end connection; and, said mandrel having a valve positioned in said mandrel bore, said valve operable between open and closed positions by axial movement of said mandrel relative to said tool body.

2. The tool of claim 1, wherein:

said tool body includes a main body, an upper body and a lower body; and, said main body supporting said at least one second connector for releasably connecting said tool body to the seal assembly.

3. The tool of claim 2, wherein:

said at least one first connector is located on said lower body.

4. The tool of claim 3, wherein:

said upper body comprises a frangible connector securing said upper body to said pressure responsive shuttle piston prior to the seal assembly being urged into the annulus between the hanger and the surrounding tubular.

5. The tool of claim 4, wherein:

said pressure responsive shuttle piston further comprises at least one actuator rod secured to an actuator rod head, said actuator rod head connected to said shuttle piston by a second frangible connector that is broken when the seal is urged into the annulus between the casing hanger and the surrounding tubular.

6. The tool of claim 5, wherein:

said lower body includes a plurality of latching dogs spaced circumferentially thereon, said latching dogs urged into engagement with the hanger by axial movement of a latching ring positioned on said mandrel when said mandrel is axially moved relative to said lower body.

7. The tool of claim 6, wherein:

said tool body and said shuttle piston comprise at least one flow return passage, said flow return passage cooperating with at least one flow return passage in the hanger to allow cementing of a string attached to the lower end of the hanger prior to urging the seal assembly into the annulus between the hanger and the surrounding tubular.

8. The tool of claim 7, wherein:

said lower body operably connected to said valve by a pin for rotating a ball in said valve between said open and closed positions.

9. The tool of claim 8, wherein:

said at least one second connector comprises at least one latching segment for retaining the seal assembly in a position axially displaced above the casing hanger during installation, said at least one latching segment when presented as a plurality of latching segments has them circumferentially spaced around said main body of said tool body.

10. The tool of claim 9, wherein:

said plurality of latching segments are released from the seal assembly by pressure applied in the bore of said mandrel which shifts said shuttle piston relative to said tool body.

11. The tool of claim 10, wherein:

said frangible connector secures said upper body to said pressure responsive shuttle piston prior to the seal assembly being urged into the annulus between the hanger and the surrounding tubular and further comprises at least one bolt.

12. An installation tool for landing a hanger in a surrounding tubular and setting a seal assembly in the annulus between the hanger and surrounding tubular, comprising:

a mandrel having an upper end for connection to connect to a first string of pipe and a bore therethrough;

a tool body having a lower end for connection to a second string of pipe, said tool body carried by said mandrel;

said tool body having a main body, an upper body and a lower body, said mandrel and said tool body axially moveable relative to one another; at least one latching dog positioned circumferentially on said tool body for releasably connecting said tool body to the hanger;

at least one latching segment on said tool body for releasably connecting said tool body to the seal assembly, without rotation of said upper end connection of said mandrel;

a pressure responsive shuttle piston on said mandrel, said shuttle piston axially moveable to urge the seal assembly into the annulus between the hanger and the surrounding tubular in which said hanger is landed; and, said mandrel having a ball valve positioned in said mandrel bore, said ball valve operable between open and closed positions by axial movement of said mandrel relative to said tool body.

13. The tool of claim 12, wherein:

said upper body is secured to said pressure responsive shuttle piston prior to said the seal assembly being urged into the annulus between the hanger and the surrounding tubular.

14. The tool of claim 13, wherein:

said pressure responsive shuttle piston further includes at least one actuator rod secured to an actuator rod head, said head selectively connected to said shuttle piston for release when the seal is urged into the annulus between said casing hanger and the surrounding tubular.

15. The tool of claim 14, wherein:

said latching dog is urged into engagement with the hanger by axial movement of a latching ring positioned on said mandrel when said mandrel is axially moved relative to said-tool body.

16. The tool of claim 15, wherein:

said tool body and said shuttle piston comprising at least one flow return passage, said flow return passage cooperating with at least one flow return passages in the hanger to allow cementing of a tubular string attached to the lower end of said hanger prior to urging the seal assembly into the annulus between said hanger and the surrounding tubular.

17. The tool of claim 16, wherein:

said tool body comprises a ball pin for operating said ball valve by axial movement of said mandrel relative to said tool body.

18. The tool of claim 17, wherein:

said latching segment is released from the seal assembly by pressure applied in the bore of said mandrel which shifts said shuttle piston relative to said tool body.

19. An assembly for delivering a tubular string into a surrounding tubular for support in the surrounding tubular, comprising:

a mandrel assembly having an upper end connection to a delivery string;

a gripping member on said mandrel assembly for selective release from the tubular string, without rotation of said upper end connection of said mandrel or inserting a dart into said mandrel assembly, after delivery of said tubular string to a supported position in the surrounding tubular;

a seal member on said mandrel assembly selectively actuable by said mandrel assembly into an abutting relation with the surrounding tubular.

20. The assembly of claim 19, wherein:

said gripping member is selectively initially engaged to the tubular string for delivery to a supported position in the surrounding tubular without rotation of said upper end connection.

21. The assembly of claim 20, wherein:

said seal member is actuable by said mandrel without rotation of said upper end connection.

22. The assembly of claim 19, wherein said mandrel assembly further comprises:

a mandrel;

a tool body slidably mounted to said mandrel and supporting the tubular string.

23. An assembly for delivering a tubular string into a surrounding tubular for support in the surrounding tubular, comprising:

a mandrel assembly having an upper end connection to a delivery string;

a gripping member on said mandrel assembly for selective release from the tubular string, without rotation of said upper end connection of said mandrel, after delivery of said tubular string to a supported position in the surrounding tubular;

a seal member on said mandrel assembly selectively actuable by said mandrel assembly into an abutting relation with the surrounding tubular;

said mandrel assembly further comprises:

a mandrel;

a tool body slidably mounted to said mandrel and supporting the tubular string;

a through passage in said mandrel and a valve mounted in said passage, said valve actuable by relative sliding movement between said mandrel and said tool body.

24. The assembly of claim 23, further comprising:

a piston actuated by pressure within said passage when said valve is in a closed position to actuate said gripping member and said seal member in a predetermined order.

25. The assembly of claim 24, wherein:

said gripping member comprises a plurality of circumferentially spaced latching dogs;

said seal member is releasably mounted to said tool body to allow said mandrel and tool body to be removed from the surrounding tubular while leaving the tubular string supported in the surrounding tubular and said seal member likewise supported in the surrounding tubular.

26. An assembly for delivering a tubular string into a surrounding tubular for support in the surrounding tubular, comprising:

a mandrel assembly having an upper end connection to a delivery string;

a gripping member on said mandrel assembly for selective initial engagement to the tubular string, and for selective release from the tubular string without rotation of said upper end connection of said mandrel or inserting a dart into said mandrel assembly, for delivery of said tubular string to a supported position in the surrounding tubular;

a seal member on said mandrel assembly selectively actuable by said mandrel assembly into an abutting relation with the surrounding tubular.

27. The assembly of claim 26, wherein said mandrel assembly further comprises:

a mandrel;

a tool body slidably mounted to said mandrel and supporting the tubular string.

28. The assembly of claim 27, further comprising:

a through passage in said mandrel and a valve mounted in said passage, said valve actuable by relative sliding movement between said mandrel and said tool body.

29. The assembly of claim 28, further comprising:

a piston actuated by pressure within said passage when said valve is in a closed position to actuate said gripping member and said seal member in a predetermined order.

30. The assembly of claim 29, wherein:

said gripping member comprises a plurality of circumferentially spaced latching dogs;

said seal member is releasably mounted to said tool body to allow said mandrel and tool body to be removed from the surrounding tubular while leaving the tubular string supported in the surrounding tubular and said seal member likewise supported in the surrounding tubular.

* * * * *